United States Patent [19]

Hastings et al.

[11] 4,330,772

[45] May 18, 1982

[54] PUSHBUTTON CIRCUIT BREAKER SWITCH

[75] Inventors: Jerome K. Hastings, Sussex; George F. Lamboy, Waukesha, both of Wis.

[73] Assignee: Eaton Corporation, Cleveland, Ohio

[21] Appl. No.: 146,947

[22] Filed: May 2, 1980

[51] Int. Cl.[3] ..... H01H 73/30

[52] U.S. Cl. ..... 337/43; 200/144 R; 200/145; 335/11; 335/14; 335/186; 337/66

[58] Field of Search ..... 337/2, 3, 12, 13, 41, 337/42, 43, 49, 66, 67, 68, 75, 110; 200/144 R, 145; 335/11, 14, 186

[56] References Cited

U.S. PATENT DOCUMENTS

| | | | |
|---|---|---|---|
| 2,128,999 | 9/1938 | Frank et al. | 200/151 |
| 2,230,428 | 2/1941 | Frank | 200/151 |
| 2,450,256 | 9/1948 | Rowe | 200/151 |
| 3,213,229 | 10/1965 | Carlson et al. | 200/68 |
| 3,258,830 | 7/1966 | Pityo | 29/630 |
| 3,491,218 | 1/1970 | Robbins | 200/68 |
| 3,617,971 | 11/1971 | Ellenberger | 337/66 |
| 4,001,738 | 1/1977 | Terracol et al. | 335/16 |
| 4,023,885 | 5/1977 | Snowdon et al. | 339/278 R |
| 4,096,368 | 6/1978 | Grebner | 200/314 |
| 4,132,967 | 1/1979 | Gryctko | 335/11 |
| 4,149,053 | 4/1979 | Long | 200/157 |

*Primary Examiner*—William H. Beha, Jr.
*Attorney, Agent, or Firm*—C. H. Grace; W. A. Autio

[57] ABSTRACT

A pushbutton circuit breaker switch, including two sets of contacts, connected in series. One set of contacts, the switch contacts (24, 30), open and close during normal on-off switch cycling. The other set of contacts, the breaker contacts (36, 42, 54), open only on overload, leaving the switch contacts closed. Of the three breaker contacts, two are stationary (36, 42) and one is a movable bridging contact (54). This movable contact is mounted on an insulative slide block (44), and an overload slides into an insulative enclosure (10g) in the housing (10) of the switch. Thus the movable contact is almost completely surrounded by insulative material cutting off any arc formed. The switch contacts are opened and closed by a W-cam (16). The actuator for the W-cam is a trapeze spring (14), the length of the horizontal portion of which is greater than the width of the W-cam, so that the center high point (16a) of the W-cam passes through the actuator without interference therewith.

14 Claims, 8 Drawing Figures

PUSHBUTTON CIRCUIT BREAKER SWITCH

BACKGROUND OF THE INVENTION

This invention relates to switches which protect from overload the circuits they control and particularly to those circuit breaker switches having high current interrupting capability and long life expectancy suitable for use in high altitude applications, such as in aircraft. The invention also relates to pushbutton switches, that is, switches which are changed to the conducting or "ON" state on the push of a button, and changed to the non-conducting or "OFF" state on the next push of the same button.

Switches known in the art are generally designed to operate at sea level or thereabouts. At low altitudes, air is a good electrical insulator, so that most switches simply open the contacts to break the circuit, and even high currents can be interrupted in this manner. As altitude increases, however, and air pressure drops commensurately, the ability of air to interrupt arcs is decreased. Near an altitude of 60,000 feet the arc-interrupting ability of air is at its lowest. At this point simply opening contacts in free air is not effective to interrupt large currents.

Previous solutions to the problem of interrupting large currents involved the use of a double break configuration, with two of the contacts stationary and the third a bridging contact, movable into and out of connection with the stationary contacts, as described in Frank et al, U.S. Pat. No. 2,128,999, issued Sept. 6, 1938. In that patent the arc was further extinguished by the attachment of an insulator to the movable briding contact, such that when the bridging contact was moved the insulator was interposed between the stationary contacts.

A common method of closing the contacts in a pushbutton switch is by means of a "W-cam" and a solid actuator therefor, as illustrated in Robbins U.S. Pat. No. 3,491,218, issued Jan. 20, 1970. In designs such as is employed there, however, the actuator must be long in relation to the cam in order to work properly. This results in a loss of compactness, since the entire switch must be large in order to accommodate the actuator.

SUMMARY OF THE INVENTION

This invention involves a pushbutton actuated circuit breaker switch which attains the desirable characteristics of very compact size and very high current interruption capability, even at such high altitudes as 60,000 feet or more. These characteristics are attained by the use of two sets of contacts connected in series, a pair of switch contacts which open or close as the switch is turned off or on under normal conditions, and a set of breaker contacts, which open under overload conditions, leaving the switch contacts closed. The breaker contacts comprise two stationary contacts and one movable bridge contact, the latter being mounted on an insulator such that when the bridging contact moves away from between the stationary contacts, as would be the case under overload conditions, the insulator is interposed between the stationary contacts. In addition, the bridging contact moves into an insulated enclosure just large enough to accommodate it. Thus the bridging contact is almost completely surrounded by insulative material except for a few very small air spaces. Any arcing that occurs in these air spaces, serves to raise the temperature and hence the air pressure in the spaces, extinguishing the arc.

One of the switch contacts is attached to a W-shaped cam, and these contacts are then opened and closed by action of the pushbutton, which is attached to the actuator of the W-cam. The actuator is not solid but rather a spring in the shape of a squared off "U", or a trapeze. The crossbar of this "trapeze" spring is longer than the W-cam is wide, so that the upright arms of the trapeze spring do not strike the W-cam on actuation of the switch. This allows shortening of the length of the actuator and hence of the entire switch body.

One object of the invention is to provide a switch which is protected from overloads and which is actuated by means of a pushbutton.

Another object of the invention is to provide a pushbutton circuit breaker switch as described above with the capability to interrupt large currents, and yet being very compact in size.

A more specific object of the invention is to provide a pushbutton circuit breaker switch having two sets of contacts, switch contacts and breaker contacts, connected serially, so that the switch contacts do not carry the burden of interrupting large currents, and so that the breaker contacts are not unnecessarily worn by actuation during normal switch cycling.

Another specific object of the invention is to provide a pushbutton circuit breaker switch as described above wherein the switch contacts are opened and closed by means of a W-cam, which is actuated by a trapeze spring, which is smaller than other actuators and allows for more compact design.

Another specific object of the invention is to provide a pushbutton circuit breaker switch as described above which is "trip-free", that is, which cannot be reset or manually held in a closed position as long as an overload condition exists.

Other objects and advantages of the present invention will hereinafter appear.

DESCRIPTION OF THE PREFERRED EMBODIMENT

Figure 1:
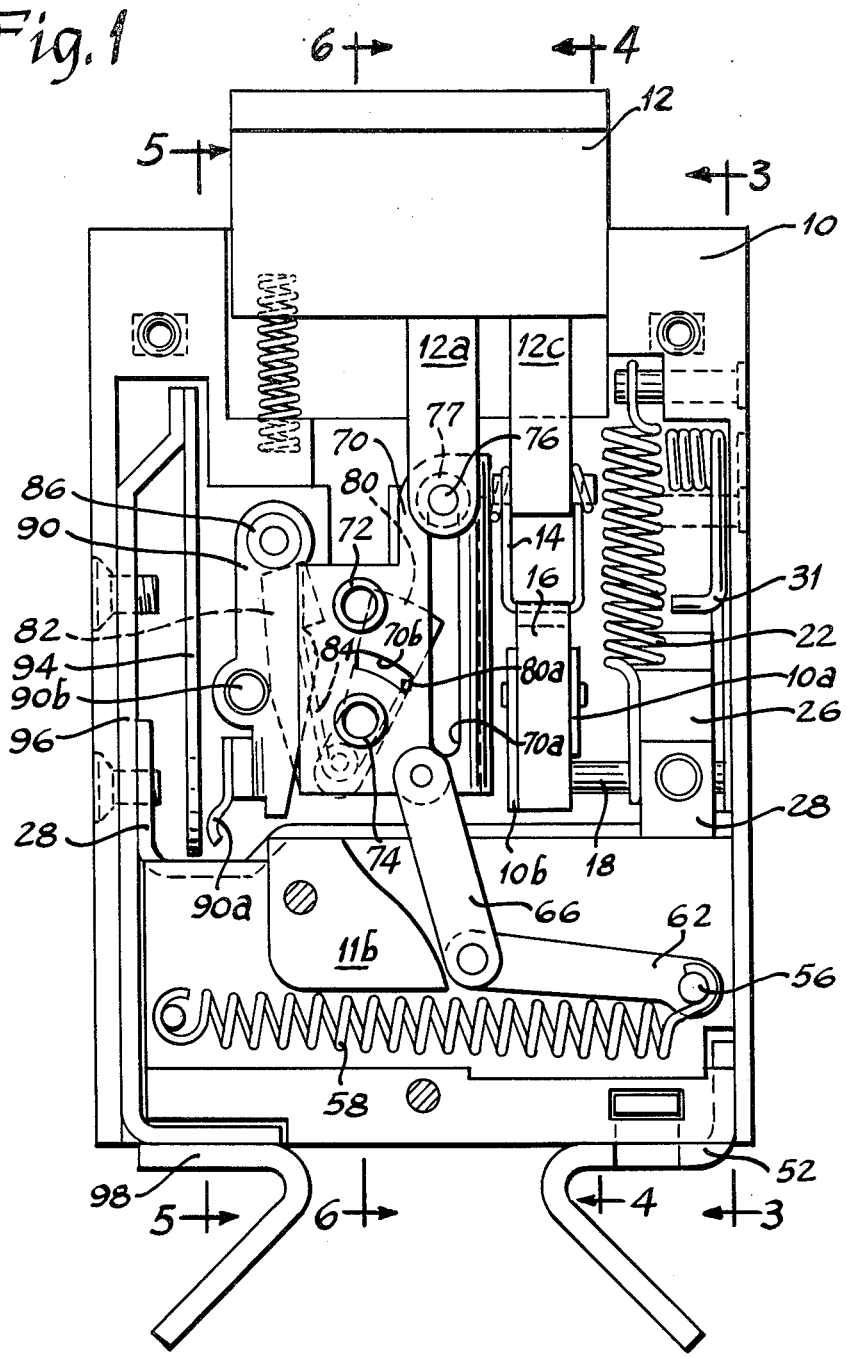
FIG. 1 is a side elevation view of a switch constructed according to the invention wherein the side cover is removed and the breaker contacts are closed.

Referring to FIG. 1, an insulative housing 10 of generally rectangular shape is provided, with a flat cover 11 (FIGS. 3, 4, 5 and 6) attached thereover by means of bolts or screws to protect the parts inside. Extending from the top of housing 10 is a pushbutton 12, which in turn has three legs 12*a*, 12*b* and 12*c* protruding from its bottom. Leg 12*b* is shown in FIG. 6.

A W-cam actuator 14, which is formed in the shape of a squared-off U, or a trapeze, is pivotably attached to leg 12*c*. As shown in FIGS. 1, 2, 4 and 8, a W-shaped cam 16 is pivotably attached to supports 10*a* and 10*b* of housing 10. The length of the horizontal portion of the trapeze spring actuator 14 is greater than the width of the W-cam 16, so that when the pushbutton 12 is pushed, and the trapeze spring moves the W-cam, the center high point 16*a* of the W-cam 16 does not interfere with the actuator 14, but rather fits between the upright portions. Thus the simplicity of W-cam actuation of a pushbutton switch can be confined in a smaller volume than was previously necessary with solid actuators.

Figure 3:
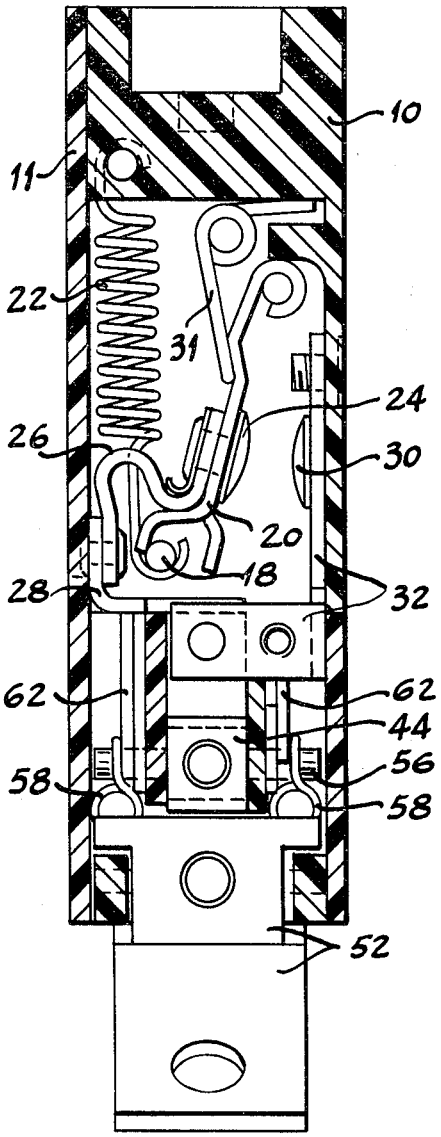
FIG. 3 is a cross-sectional view taken along line 3—3 of FIG. 1.

Inserted through the lower portion of W-cam 16 is a rod 18, which is also held up under a bracket 20 by a spring 22, as illustrated in FIG. 3. The end of bracket 20 opposite rod 18 is pivotably connected to housing 10. A spherical contact 24 is attached to one side of bracket 20, preferably by means of riveting. A connector strap 26 is attached to the opposite side of bracket 20 by the same rivet. The opposite end of connector strap 26 is attached to a bus bar 28. Another spherical contact 30 is securely attached to another bus bar 32 which is secured to housing 10, aligned so that movable switch contact 24 makes good electrical contact with stationary switch contact 30 when bracket 20 is swung toward it. A spring 31 ensures non-zero contact pressure on closure of the contacts.

Figure 2:
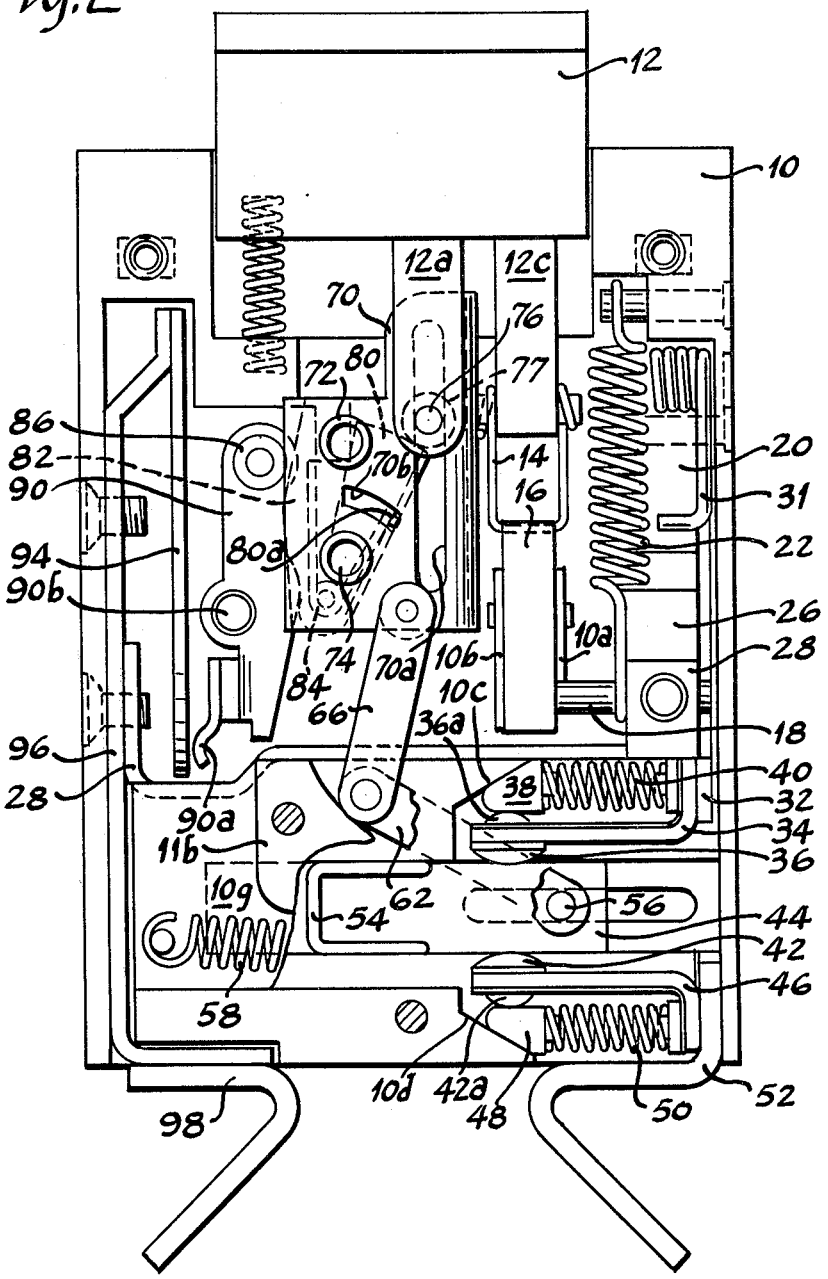
FIG. 2 is the same as FIG. 1 except that part of the arm and breaker contact cover are removed and the breaker contacts are shown open.

Referring now to FIG. 2, bus bar 32 is connected to a conductive member 34, on the end of which is attached a cylindrical contact 36. Contact 36 is attached to member 34 preferably by riveting, so that the spherical rivet head 36*a* protrudes from the back of member 34. A wedge 38 is then interposed between rivet head 36*a* and an inclined surface 10*c* of housing 10, in order to maintain a downward force on contact 36. Wedge 38 is held in place by a spring 40.

Contact 36 is separated from another cylindrical contact 42 by a slide block 44 which is made of insulative material. Similar to contact 36, contact 42 is attached to a conductive member 46, preferably by means of riveting. Contact 42 is forced against slide block 44 by means of a wedge 48 interposed between rivet head 42*a* and an inclined surface 10*d* of housing 10. Again, wedge 48 is held in place by a spring 50. Conductive member 46 is connected to an electrical terminal 52, which is adapted to be connectable to a source of electrical current. Contacts 36 and 42 are cylindrical to give a larger contact area than that obtained by use of spherical contacts, which results in longer life for the contacts.

Fitted closely around an end of slide block 44 is a bridging contact 54. Contact 54 is depressed into the sides of the slide block 44 which touch the stationary contacts 36 and 42, so that when the slide block 44 is moved, the bridging contact 54 can slide smoothly between contacts 36 and 42, while still making good electrical contact with the contacts.

Inserted through an aperture in slide block 44 near the end opposite contact 54 is a rod 56, on each end of which are hooked springs 58. These springs tend to force bridging contact 54 out of contact with stationary contacts 36 and 42. Also pivotably connected to each end of rod 56 is a lower arm 62. Both of these arms 62 are pivotably connected to upper arms 66, FIG. 6, both of which are in turn pivotably connected to an actuator box 70. Finally actuator box 70 is slidably attached to legs 12*a* and 12*b* of pushbutton 12.

Figure 5:
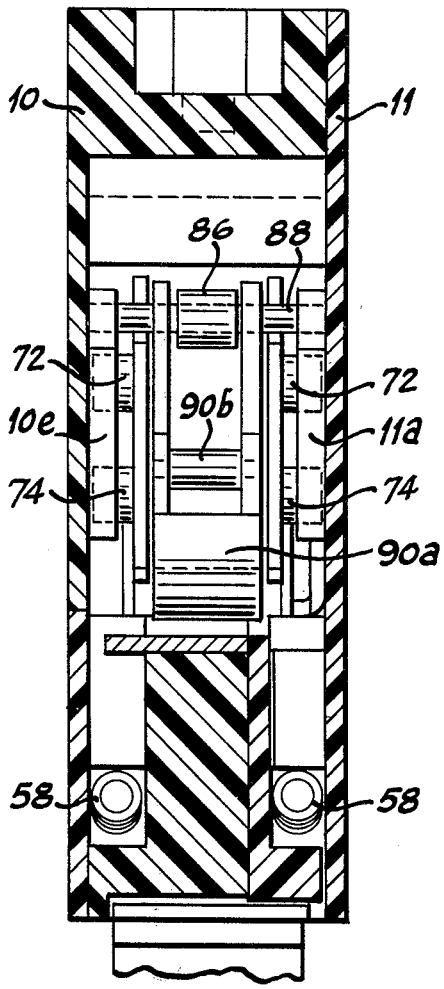
FIG. 5 is a cross-sectional view taken along line 5—5 of FIG. 1.
Figure 6:
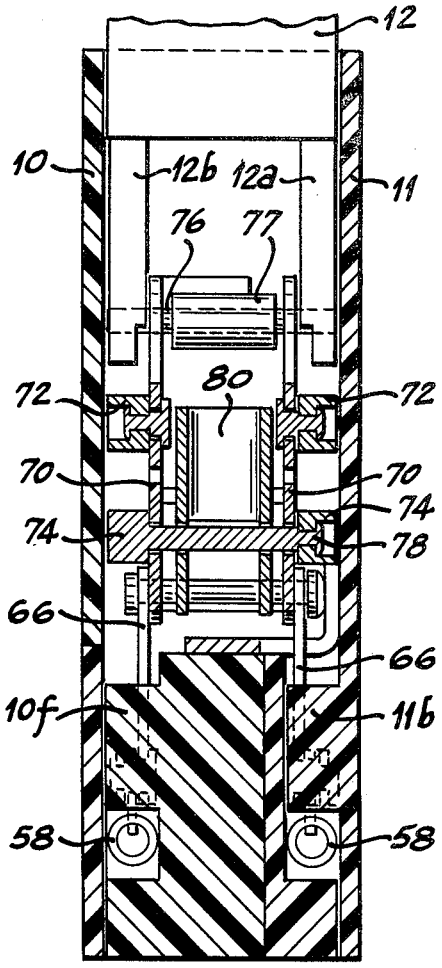
FIG. 6 is a cross-sectional view taken along line 6—6 of FIG. 1.

Actuator box 70 slides with respect to housing 10 by means of upper and lower rollers 72 and 74 respectively, which roll along projections 10*e* on housing 10 and 11*a* on cover 11, shown in FIG. 5. Box 70 slides with respect to pushbutton 12 by means of a rod 76 which passes through apertures in legs 12*a* and 12*b* and through slots 70*a* in box 70. On rod 76 between the walls of box 70 is a roller 77.

Rollers 74 are connected to each other and to actuator box 70 by means of a rod 78. Also pivotably connected to rod 78 and thus to box 70 is a latch lever 80. Another latch lever 82 is pivotably attached to latch lever 80, as shown in FIGS. 1 and 2. The point at which latch lever 80 is attached to rod 78 is offset from the point at which lever 80 is attached to latch lever 82. A spring 84, centered around the point of connection between levers 80 and 82, acts to force the non-attached ends of those levers apart.

As shown in the latched position in FIG. 1, the unattached end of lever 82 is held in place by a roller 86, which is attached by means of a shaft 88 between housing 10 and cover 11. Also attached to shaft 88 is a trip lever 90.

Figure 7:
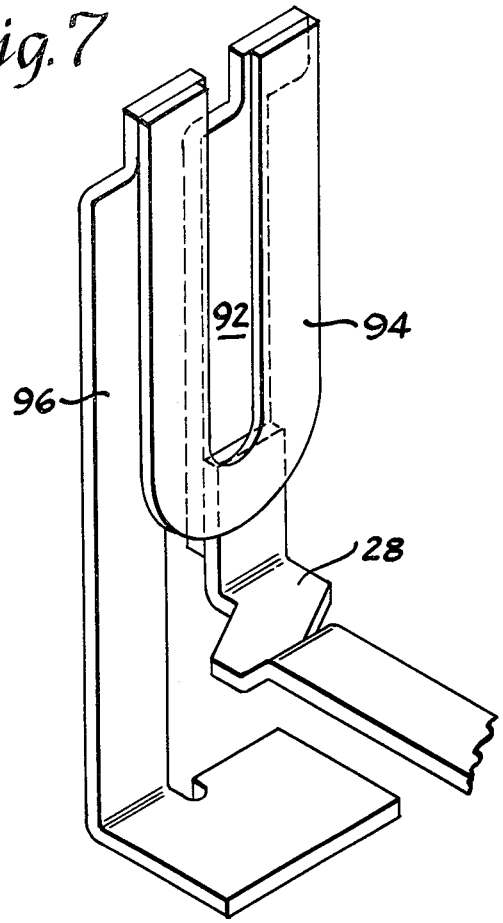
FIG. 7 is an isometric view of the bimetal trip device and parts of the bus bars connected to it.
Figure 8:
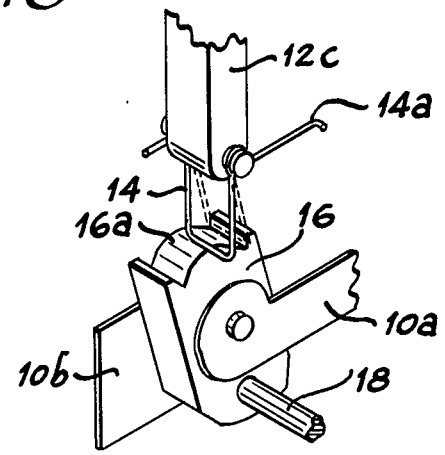
FIG. 8 is an isometric view of the W-cam and trapeze spring actuator, including support parts.

Bus bar 28 extends from connection with connector strap 26, shown in FIG. 3, to connection with a bus bar 92, as shown in FIG. 7, on the opposite side of housing 10. Bus bar 92 in turn is connected to one leg of a U-shaped bimetal 94. The opposite leg of bimetal 94 is connected to bus bar 96, which is in turn connected to a second terminal 98. Thus the current path in this switch is as follows: terminal 52 to conductive member 46 to contact 42 to bridging contact 54 to contact 36 to conductive member 34 to bus bar 32 to switch contact 30 to switch contact 24 to bracket 20 to connector strap 26 to bus bar 28 to bus bar 92 to bimetal 94 to bus bar 96 to terminal 98.

The operation of this circuit breaker switch can be described as follows: The switch is assembled with breaker contacts 36, 54 and 42 open as shown in FIG. 2, and with switch contacts 24 and 30 open as shown in FIG. 3. Pressing bushbutton 12 closes both sets of contacts at once.

Regarding the closure of the breaker contacts, the action of pushbutton 12 forces roller 77 into contact with the unattached end of lever 80, which extends partially into vertical slot 70*a* in actuator box 70. Lever 80 is prevented from rotating further into slot 70*a* by a tab 80*a* on each side of lever 80, which slides through an arcuate slot 70*b* on each side of actuator box 70. The action of the pushbutton 12 then forces the actuator box 70 downward, which in turn forces upper arms 66 downward. This downward force is translated into horizontal force, moving lower arms 62 such that slide block 44 slides, bringing bridging contact 54 into contact with the stationary contacts 36 and 42, against the force of springs 58. This change of direction of the force of the pushbutton is accomplished by means of variable slope ramps, 10*f* and 11*b*, as shown in FIGS. 1, 2 and 6, acting on the joint between upper arms 66 and lower arms 62. Finally, at about the same point that bridging contact 54 has moved into good contact with the stationary contacts 36 and 42, the actuator box 70 has moved downward sufficiently to allow the unattached end of latch lever 82 to snap outward, forced by spring 84, to the position below roller 86 shown in FIG.

1. The breaker contacts are thus latched in a closed position.

Figure 4:
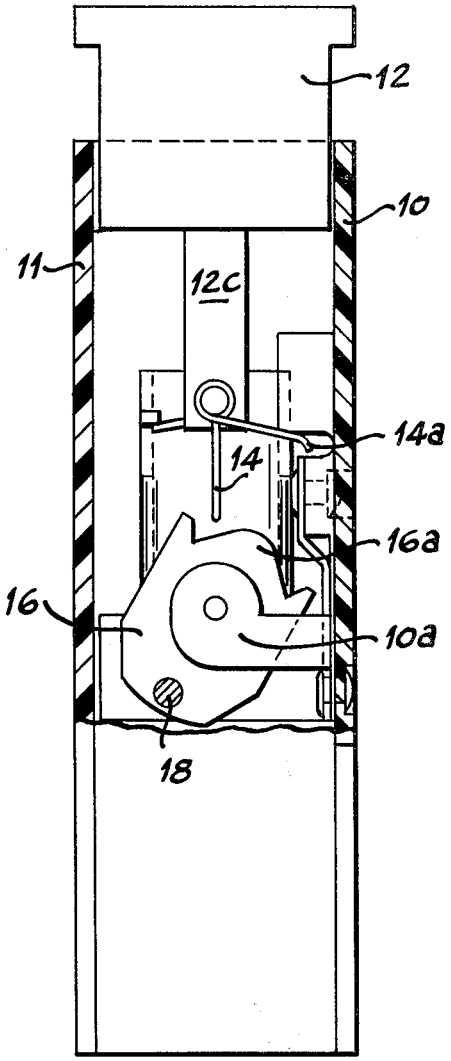
FIG. 4 is a cross-sectional view taken along line 4—4 of FIG. 1.

The same action of the pushbutton 12 which closes the breaker contacts closes the switch contacts, as described in the following sequence. The action of pushbutton 12 brings W-cam actuator 14 in contact with the W-cam 16, as shown in FIG. 4. As W-cam 16 is turned, rod 18 moves, swinging bracket 20 such that contact 24 approaches contact 30. At some intermediate point the force vector created by spring 22 changes, snapping the contacts 24 and 30 together. Spring 31 ensures a non-zero contact closure force. Thus both sets of contacts are closed.

The next action of the pushbutton 12 forces the W-cam actuator 14 onto the W-cam 16, on the side of the high point 16*a* opposite that contacted above. Switch contacts 24 and 30 are then separated by a reversal of the sequence described above. Breaker contacts 36, 42, and 54, however, are not opened by this action of pushbutton 12, since latch lever 82 remains latched under roller 86, regardless of pushbutton 12. Thus the wear of merely turning the switch on and off is borne by the switch contacts, not the breaker contacts.

Once closed, the breaker contacts are opened only upon overload, as described in the following sequence. As current through the switch increases, the unattached end of bimetal 94 bends toward trip lever 90, contacting it at a point on push pad 90*a*. As the current continues to increase, bimetal 94 bends further, forcing trip lever 90 to swing in the same direction, until bar 90*b* touches latch lever 82. Bar 90*b* then pushes latch lever 82 out from under roller 86, allowing actuator box 70 to move upward, and allowing bridging contact 54 to slide out of contact with contacts 36 and 42. The parts of the switch then assume the positions shown in FIG. 2. Switch contacts 24 and 30, however, remain closed when breaker contacts 36, 42 and 54 open on overload. In this manner the switch contacts are relieved of the burden of interrupting large currents at high altitudes.

Since the switch contacts do not open on overload, a tab 14*a* is provided to prevent trapeze spring actuator 14 from opening the switch contacts. When the switch is tripped by an overload, as described above, pushbutton 12 moves to a point farther out of housing 10 than when it is not tripped. When this happens, tab 14*a* moves actuator 14 toward the "on" side of W-cam 16. When pushbutton 12 is then pressed to reset the switch, actuator 14 does not move W-cam 16, and switch contacts 24 and 30 are not opened. Thus after being tripped by an overload the switch can be reset to an "on" condition with one action of pushbutton 12.

On overload the breaker contacts 36, 42 and 54 do not open the circuit merely by moving the contacts apart or allowing air to enter between the contacts. Rather movable bridging contact 54, attached to slide block 44, slides away from stationary contacts 36 and 42, and into a small enclosure 10*g* formed within housing 10, which fits closely around slide block 44 and contact 54. Because contact 54 is flush mounted on block 44 so that the outer surface of the contact is approximately even with the outer surface of the block, as described previously, when the block slides into enclosure 10*g*, contact 54 is almost completely surrounded by insulative material, except for very small air spaces between the side of block 44 and the walls of box 10*g*. Any arcing that occurs must occur within these small air spaces. If any arcing does occur in these small spaces, the temperature of the air therein will be raised thereby, causing an increase in air pressure to that equivalent to the air pressure at a lower altitude. Since air is a better insulator at lower altitudes, the arc will be extinguished. Thus this arrangement of the contacts is effective to extinguish arcs and interrupt large currents even at high altitudes.

When large overload currents pass through this contact structure, magnetic forces tending to force the contacts apart, termed "magnetic blow-apart forces", become significant. The arrangement of wedges 38 and 48 and springs 40 and 50, previously described, aid in absorbing these forces and in transmitting them to the housing structure, increasing the stability of the contact system during overload. The angle of the ramps 10*c* and 10*d* provides a force "gain" so that magnetic blow-apart forces seen by springs 40 and 50 during short circuit overload conditions are reduced, allowing a high contact force from a small spring. Further, bouncing of contacts 36 and 42 is minimized, and the arrangement automatically compensates for any wear of the contacts or slide block 44, as the wedges simply move along the inclined surfaces to absorb any change in thickness.

The switch is made "trip-free" (that is, once tripped it cannot be reset as long as the overload exists even if the pushbutton is manually held in) by the interaction of latch levers 80 and 82 with rollers 77 and 86 and spring 84. In an overload condition, bimetal 94 pushes trip lever 90, which pushes the unattached end of lever 82 away from roller 86, allowing actuator box 70 to move upward, as described previously. If the pushbutton 12 is then pushed down or held down during the overload, trip lever 90 continues to push latch lever 82 in the same direction. Since lever 82 is already away from roller 86, the end of lever 82 attached to latch lever 80 also moves in that same direction, causing lever 82 to rotate about its point of attachment to box 70, which point is rod 78. Thus latch levers 80 and 82 move together. The unattached end of lever 80 is thereby moved out of slot 70*a*, so that box 70 moves upward regardless of the action or position of the pushbutton. Hence as long as an overload exists, the switch cannot be reset.

A feature which aids the bimetal 94 in exerting a force on trip lever 90 is the magnetic force between bus bars 92 and 96 and the legs of bimetal 94. As a large current passes through bus bar 92 and the connected leg of bimetal 94, or through bus bar 96 and its connected leg, the current is passing through two closely spaced conductors in opposite directions. This creates a large magnetic repulsive force between the conductors, which force improves the response time of the circuit breaker, and increases the total force exerted by the bimetal over the force caused by the temperature change alone. The parts in the latch upon which the bimetal 94 acts are made of non-magnetic material so that this large magnetic force does not affect them or alter the force required to open the latch.

While the apparatus hereinbefore described is effectively adapted to fulfill the aforesaid objects, it is to be understood that the invention is not intended to be confined to the particular preferred embodiments herein set forth, inasmuch as they are susceptible of various modifications without departing from the scope of the appended claims.

I claim:

1. A circuit breaker switch comprising in combination:

an insulative housing;

first switch means mounted within said housing, comprising at least two contacts;

second switch means mounted within said housing, comprising at least two contacts, electrically connected in series with said first switch means;

a pushbutton extending from one side of said housing;

first actuation means, connecting said pushbutton to said first switch means, for closing and reopening said contacts of said first switch means in response to first and second operations of said pushbutton;

second actuation means, connecting said pushbutton to said second switch means, for closing said contacts of said second switch means in response to said first operation of said pushbutton;

trip means, electrically connected in series with said first and second switch means, for opening said second switch means on overload without opening said first switch means; and first and second terminal means, one connected to each end of the series circuit comprising said first and second switch means and said trip means, for connecting said circuit to a source of electrical current.

2. A circuit breaker switch as recited in claim 1 wherein said trip means comprises thermal trip means, whereby said opening of said second switch means results from the increase in temperature of an element caused by an increase in current passing through that element.

3. A circuit breaker switch as recited in claim 2 wherein said second switch means comprises three contacts, including two stationary contacts and one movable bridging contact for completing the electrical connection between said stationary contacts, and wherein one of said stationary contacts is electrically connected in series to one of said contacts of said first switch means.

4. A circuit breaker switch as recited in claim 3 further comprising an insulative slide block, having said movable bridging contact attached thereto, adapted to slide said movable contact into and out of contact with said stationary contacts of said second switch means, whereby said insulative slide block is interposed between said stationary contacts when said movable contact slides out of contact with them.

5. A circuit breaker switch as recited in claim 4 wherein said movable contact of said second switch means, as it moves out of contact with said stationary contacts, moves into a small enclosure in said insulative housing just large enough to accommodate said movable contact, such that when said movable contact is entirely in said enclosure it is completely surrounded by insulative material including said enclosure and said insulative slide block, except for air gaps surrounding said slide block, which gaps are small relative to said slide block.

6. A circuit breaker switch as recited in claim 5 further comprising biasing means tending to force said movable contact into said small enclosure and out of contact with said stationary contacts.

7. A circuit breaker switch as recited in claim 6 wherein said trip means further comprises latch means for holding said movable contact in contact with said stationary contacts.

8. A circuit breaker switch as recited in claim 7 wherein said second actuation means comprises:

an actuator box slidably attached to said pushbutton and attached by means of arms to said slide block; and a first latch lever pivotably attached to said actuator box which extends into a slot in said actuator box to prevent said pushbutton from sliding beyond a given point with respect to said actuator box.

9. A circuit breaker switch as recited in claim 8 wherein said latch means comprises:

a second latch lever pivotably attached to said first latch lever;

biasing means at the axis of attachment of said two latch levers, tending to force the unattached ends of said levers apart; and a roller attached to said housing, such that when said pushbutton moves said actuator box to a position where said contacts of said second switch means are closed, said second latch lever snaps outward under said roller to hold said actuator box in that position.

10. A circuit breaker switch as recited in claim 9 wherein said thermal trip means comprises:

a bimetal strip, which bends with changes in temperature;

bus bars connected to said bimetal strip for providing electrical energy and physical support thereto; and a trip lever pivotably attached to said housing, such that when an overload current passes through said bimetal strip, its temperature is increased, causing it to bend and push against said trip lever, which in turn pushes said second latch lever away from said roller, allowing said second switch means to open.

11. A circuit breaker switch as recited in claim 10 wherein the point at which said second latch lever is attached to said first latch lever is offset from the point at which said first latch lever is attached to said actuator box, such that when said trip lever pushes said second latch lever away from said roller, said first latch lever pivots out of said slot in said actuator box, allowing said actuator box to move and said second switch means to open regardless of the position of said pushbutton.

12. A circuit breaker switch as recited in claim 1 wherein said first switch means comprises at least one stationary contact and one movable contact.

13. A circuit breaker switch as recited in claim 12 wherein said first actuation means comprises a W-cam connected to said movable contact of said first switch means, and an actuator therefor pivotably attached to said pushbutton.

14. A circuit breaker switch as recited in claim 13 wherein said actuator for said W-cam comprises a trapeze spring, both ends of which are pivotably attached to said pushbutton, and the length of the horizontal portion of which is greater than the width of said W-cam, such that when said trapeze spring engages with said W-cam, the center high point of said W-cam does not interfere with said trapeze spring.

* * * * *